US005421753A

United States Patent [19]

Roos

[11] Patent Number: 5,421,753

[45] Date of Patent: Jun. 6, 1995

[54] MARINE JET DRIVE

[76] Inventor: Paul W. Roos, 2033-F W. McNab Rd., Pompano Beach, Fla. 33069

[21] Appl. No.: 699,336

[22] Filed: May 13, 1991

[51] Int. Cl.[6] ..... B63H 11/10

[52] U.S. Cl. ..... 440/43; 440/40

[58] Field of Search ..... 60/221; 440/38, 40–43, 440/47; 239/265.19, 265.21, 265.25, 265.27, 265.35

[56] References Cited

U.S. PATENT DOCUMENTS

| | | | |
|---|---|---|---|
| 3,824,946 | 7/1974 | Macardy et al. | 440/43 |
| 3,827,390 | 8/1974 | De Vault et al. | 440/41 |
| 3,976,026 | 8/1976 | Eastling | 440/43 |

FOREIGN PATENT DOCUMENTS

| | | | |
|---|---|---|---|
| 1190735 | 5/1970 | United Kingdom | 440/41 |

*Primary Examiner*—Edwin L. Swinehart

*Attorney, Agent, or Firm*—R. J. Van Der Wall

[57] ABSTRACT

This invention relates to a marine jet drive having improved operation, especially in regard to having efficient adaptation to propulsion engine and hull design; having a drive shaft with flexible coupling at each end, internal to the jet drive; having through-the-nozzle engine exhaust; having simplified, combined means of steering and reversing; having controllable nozzle aperture and trim control; having combination reverse flow deflector and trim plane; having means to disengage the engine from the jet to obtain true neutral; having protection from and removal of debris in the water intake duct; generally having fewer overhauls, easier serviceability and lighter weight.

11 Claims, 5 Drawing Sheets

MARINE JET DRIVE

FIELD OF THE INVENTION

This invention relates to an engine driven marine vehicle water jet propulsion apparatus, whereby said apparatus has a plurality of improvements, relating to safety, efficiency, material of construction, adaptability to varied applications, longevity, serviceability, weight and operator comfort.

BACKGROUND OF THE INVENTION

Marine Jet drives propelling a vessel based on water jet propulsion have long been known and used due to certain advantages over the traditional external ship's propeller. An engine driven impeller, rotating inside an impeller housing pumps water from below the vessel through an intake duct, then pressurizes and expels said water through a diffusor housing and a nozzle horizontally behind the vessel. A typical example of such a conventional marine jet drive is seen in U.S. Pat. No. 3,935,833, which shows a pump, that may be driven vertically or horizontally and is positioned near the bottom and transom of a marine vessel. The conventional jet propulsion systems have certain general advantages that make them especially attractive under circumstances where a conventional ship's propeller would be exposed to damage by contact with underwater objects. A jet drive has the further advantage that it does not produce appendage drag and is safe for swimmers and animals who could be hurt by the rotating blades of an external propeller.

The known jet drives have, however, certain drawbacks compared with the conventional external propeller propulsion system. A major drawback is caused by the large size and weight of the steering and reversing deflectors, used in conventional jet drives, as well as a lack of ability to steer the vessel in case of loss of engine power.

Transom interference with forward water flow during reverse operation hinders the otherwise good reverse and maneuvering capability of a conventional marine jet drive; likewise, trim planes are incompatible in conjunction with conventional jet drive reversing systems because said planes block said forward water flow. Another drawback is the placement of steering and reversing hydraulic control cylinders, hydraulic hoses, position feedback cables, and lubricating hoses outside the vessel, exposed to water and the weather where corrosion and marine growth damage exposed rod ends, hydraulic seals and hoses.

Further, because of the recited deficiencies, conventional jet drives require time consuming disassembly and frequent servicing and repair.

It is accordingly a primary object of the present invention to provide a marine jet drive propulsion system that overcomes the disadvantages of the known jet drives. In particular, the jet drive according to the present invention provides a combined steering and reversing mechanism that is lighter in weight and smaller in dimension and has improved performance. U.S. Pat. No. 4,538,997 displays a reversing means, whereby a single, centrally located reversing scoop moves up from the bottom of a steering tube, deflecting water for reversing down and forward. The present invention uses a single fixed split duct with right and left ports or twin reverse ducts, fastened to left and right steering deflectors, sending water flow forward and angled away from the intake duct during reverse operation and is in concept different from the referenced patent.

A set of steering vanes may be provided, attached to the outer surfaces of the reverse ducts, as they are fastened to the steering/reverse deflectors and move with said deflectors. U.S. Pat. No. 3,982,494 provides for an auxiliary rudder that is actuated by the jet pump pressure and swings out of the way at higher speeds, to reduce drag. The present invention uses the reverse ducts, also a subject of the present invention, to rigidly support the steering vanes.

Also provided is reverse operation eliminating backwash against the transom using a reverse/trim plane in close proximity to the jet drive, that retracts to a position above the reverse ducts during reverse operation forcing all forward water flow underneath the vessel. In forward direction the reverse/trim plane may be adjusted like a trim plane.

The mechanical or hydraulic controls, operating the combined steering/reversing deflectors, the nozzle aperture inserts and reverse/trim plane are placed inside the vessel to avoid marine growth and weather exposure. They are however attached to the impeller housing forward flange. Sliding control rods with water seals at the transom connect said deflectors, aperture inserts and reverse/trim plane to the mechanisms inside. This allows the installation and adjustment of said mechanisms to be done at the factory, without the need of having the intake duct present. Additionally, these control mechanisms have a park position whereby all control rods are pulled into their retracted positions, preventing damage from corrosion and marine growth to the sealing surfaces, while the vessel is idle for extended periods of time. Even in the event of failure of said water seals, only water will leak into the vessel and no oil will leak into the water, avoiding pollution and hydraulic system failure.

Further, construction, operation, weight reduction and maintenance features are part of the invention, as will be described in detail in the following presentation with appended drawings and claims.

SUMMARY OF THE INVENTION

Bearing in mind the foregoing, a principal object of the present invention is obtaining a lower bulk and lower weight steering and reversing system with left and right steering/reversing deflectors, attached to the jet nozzle so that they can rotate in the horizontal plane; the shape of said steering deflectors chosen in a manner, that engagement of either deflector with the jet stream causes a deflection of said jet stream and a resulting steering response in the opposite direction; when both deflectors are closed cutting off the rearward flow of the jet stream, a baffle arrangement forces the jet stream down into reverse ducts splitting the stream into a right and left duct and directing it forward and underneath the vessel, to effect a reverse reaction. Moving the deflectors in unison, while closed, will deflect more water to the left or right reverse duct, so obtaining steering in reverse. A neutral position may be found by closing the steering/reverse deflectors part way until the forward and reverse forces balance. Steering vanes may be attached to said deflectors, to obtain steering when engine is not running.

Another collateral object is reverse operation, eliminating backwash against the transom using a reverse/-trim plane in close proximity to the jet drive retracting above the reverse duct discharge ports during reverse operation forcing all forward water flow underneath the vessel. In forward direction it is adjusted and functions like a trim plane.

A further collateral object is the mechanical or hydraulic control of the combined steering and reversing deflectors and reverse/trim plane from inside the vessel to avoid marine growth and weather exposure to the control mechanisms; said control mechanisms however being attached to the impeller housing forward flange, allowing the installation and adjustment of said mechanisms to be done at the factory, without the need of having the intake duct present. Sliding control rods with water seals at the transom connect said deflectors and reverse/trim plane to the mechanisms inside. Additionally, these control mechanisms have a park position whereby all control rods are pulled into their retracted positions, to prevent corrosion and growth on the sealing surfaces of said control rods during idle periods.

Further objects and advantages of this invention will be apparent from the following detailed description of a presently preferred embodiment which is illustrated schematically in the accompanying drawings.

Before explaining the disclosed embodiments of the present invention in detail it is to be understood that the invention is not limited in its application to the details of the particular arrangements shown since the invention is capable of other embodiments. Also, the terminology used herein is for the purpose of description and not of limitation.

DETAILED DESCRIPTION OF THE PREFERRED EMBODIMENTS

Figure 1:
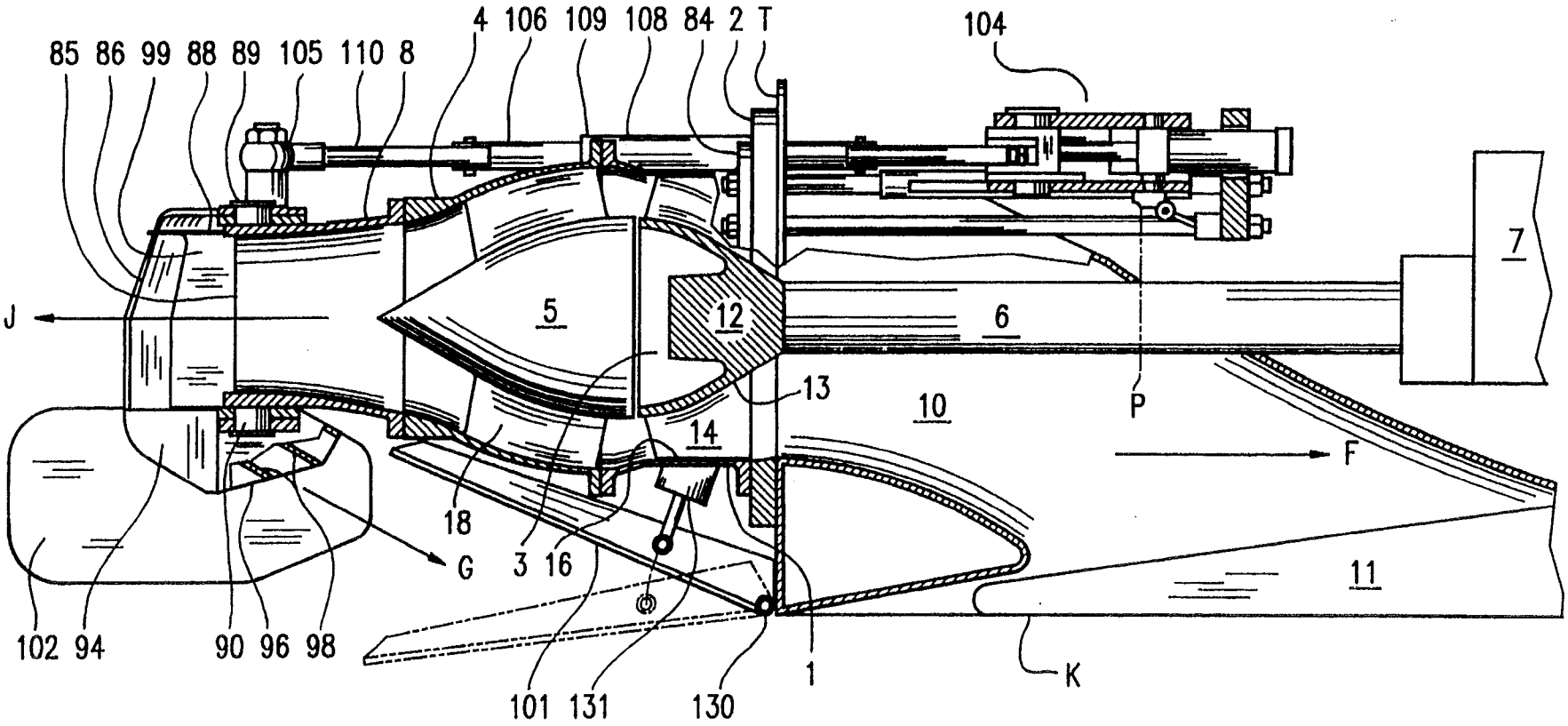
FIG. 1 is a cross sectional view over the shaft centerline, to show the interior construction.
Figure 2:
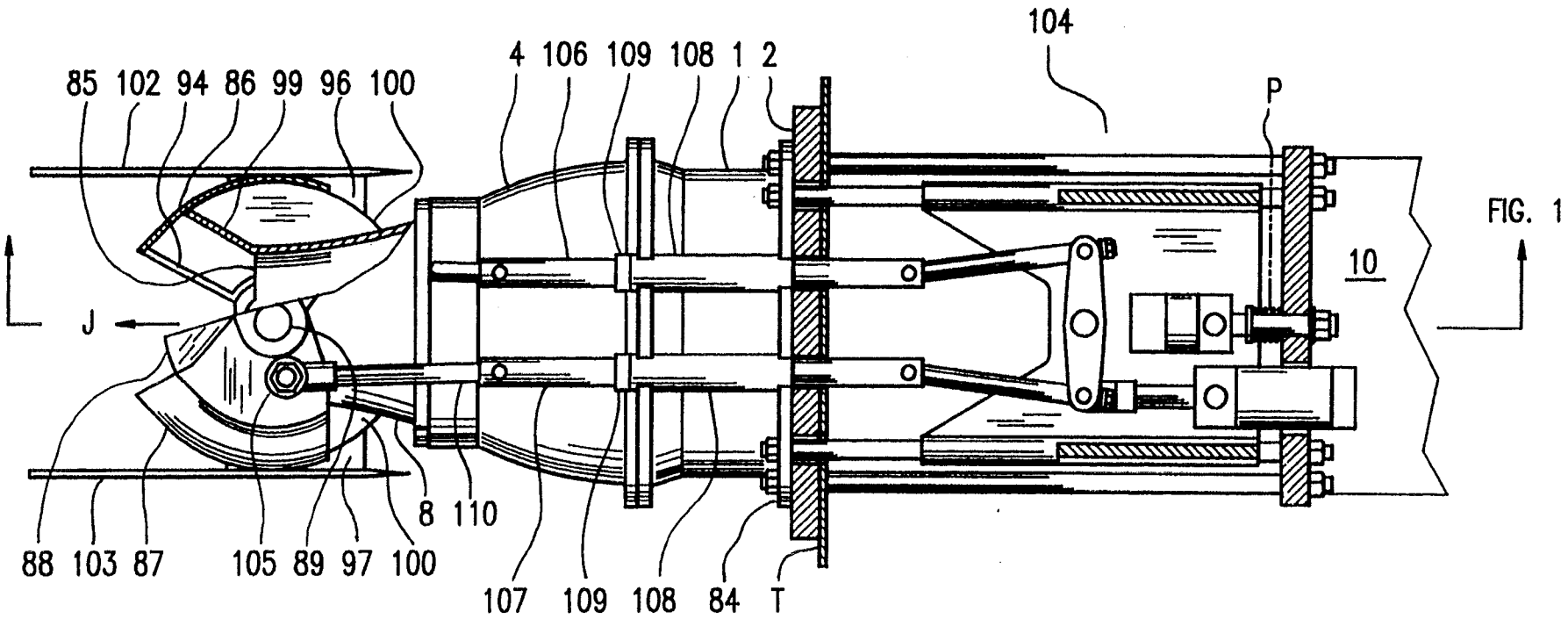
FIG. 2 is a partially broken plan view of the invention.

In accordance with the invention there is provided a marine jet drive as shown in FIGS. 1 and 2, located generally at the transom T of a vessel and generally above the keel line K, with the direction of the jet stream J rearward, to promote said vessel's movement forward as indicated by arrow F. Said jet drive has an impeller housing 1, attached to intake flange 2; a rotatable impeller 3, disposed in impeller housing 1, its axis of rotation aligned generally with keel line K; a diffusor housing 4 connected to the impeller housing 1 forming a water outlet port; an inner housing 5, disposed inside diffusor housing 4; a drive shaft 6, rotatively connecting the impeller 3 with the engine 7; a nozzle housing 8 forming a rearward facing nozzle, attached to the diffusor housing 5, having means of deflecting jet stream J; a water intake duct 10, placed ahead of the impeller housing, attached to the vessel and transmitting the generated thrust forces to said vessel; and an intake grid 11, disposed in the intake duct 10.

Impeller 3 includes an impeller hub 12, an impeller bell 13 and a plurality of impeller blades 14 having blade tips 16 radially extending from the impeller bell 13. The blades 14 are advantageously positioned to promote fluid flow from the intake duct 10 to the diffusor housing 4 when the impeller 3 rotates.

The diffusor housing 4 supports the inner housing 5 by a plurality of stator vanes 18, radially disposed between diffusor housing 4 and inner housing 5, as seen in FIGS. 1 and 2. The stator vanes 18 are advantageously positioned to recover the rotational energy, imparted by the impeller 3.

Figure 3:
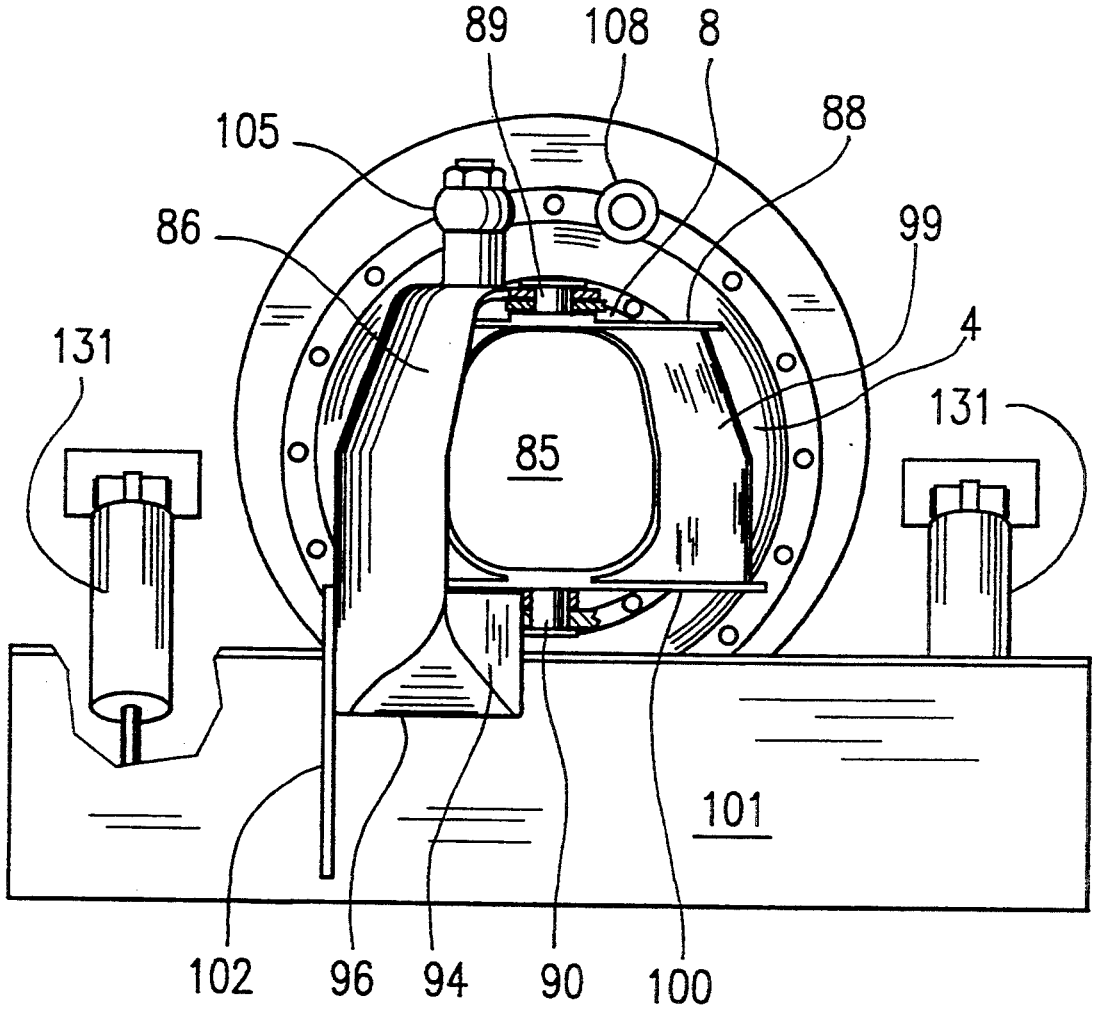
FIG. 3 is an end elevation view of the invention looking forward, showing the left steering/reversing deflector (the right deflector is omitted to show the nozzle and baffles) and reverse/trim plane arrangement.

The jet drive further includes a nozzle housing 8, at the rearward end forming the nozzle discharge port 85, to accelerate the jet stream and is shaped on the outside to accommodate and support the left and right steering/reversing deflectors 86 and 87. The nozzle discharge port 85 is shaped advantageously, to promote the efficient functioning of said nozzle port, the efficient deflection of the jet stream J for steering while moving forward, and the efficient deflection for reversing and steering while in reverse. This shape may be circular, oval, rectangular or trapezoidal or any combination of these shapes. The present embodiment in cross sectional view, prefers a shape symmetrical about a vertical axis through the center of the impeller axis, of trapezoidal shape for the upper half of the nozzle and of rectangular shape for the bottom half of the nozzle discharge port 85, with the upper and lower corners rounded off in circular shape, as best shown in FIG. 3.

Figure 4:
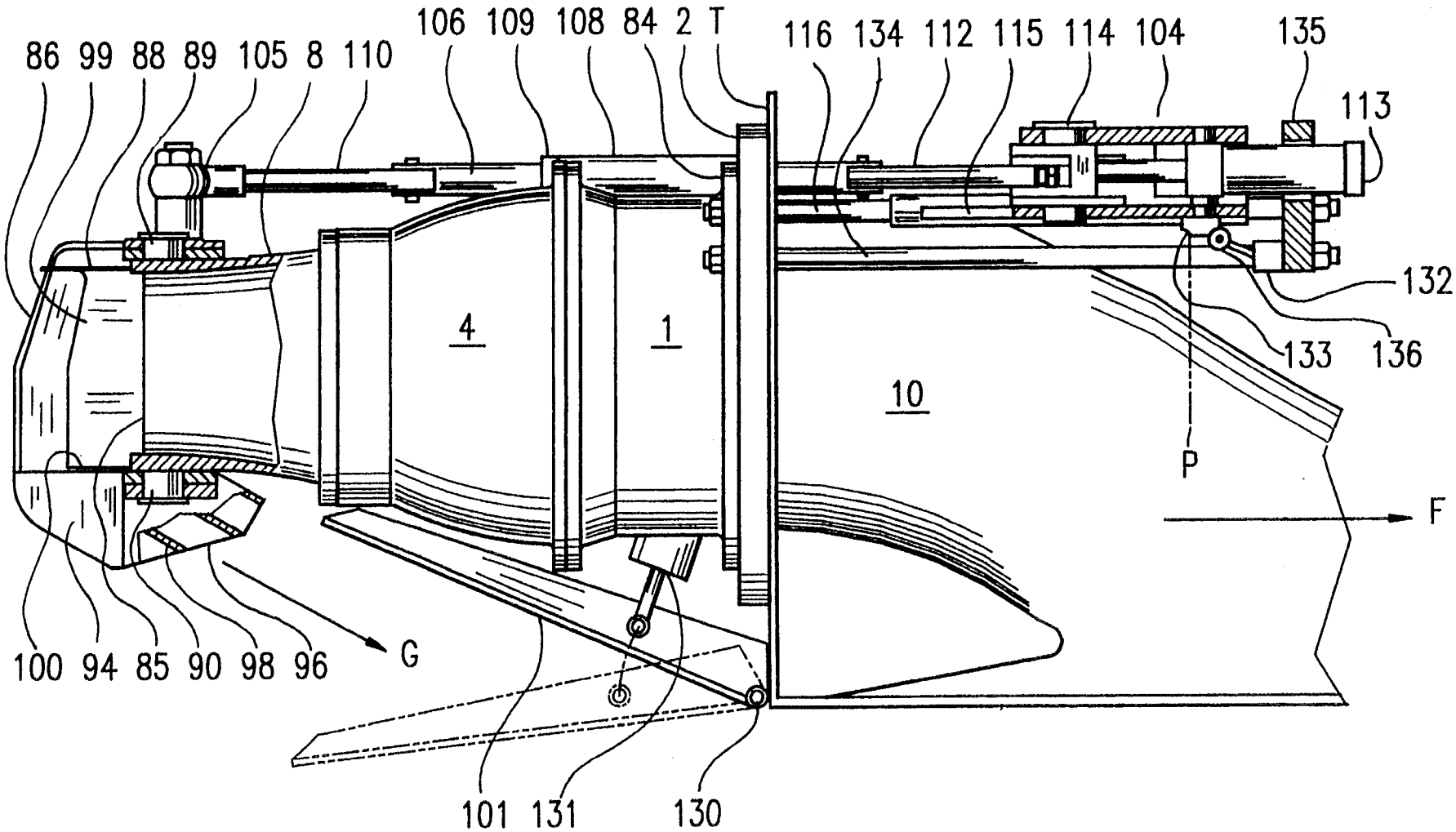
FIG. 4 is a fragmentary partially broken elevational view of the invention to show the steering and reversing mechanism.
Figure 5:
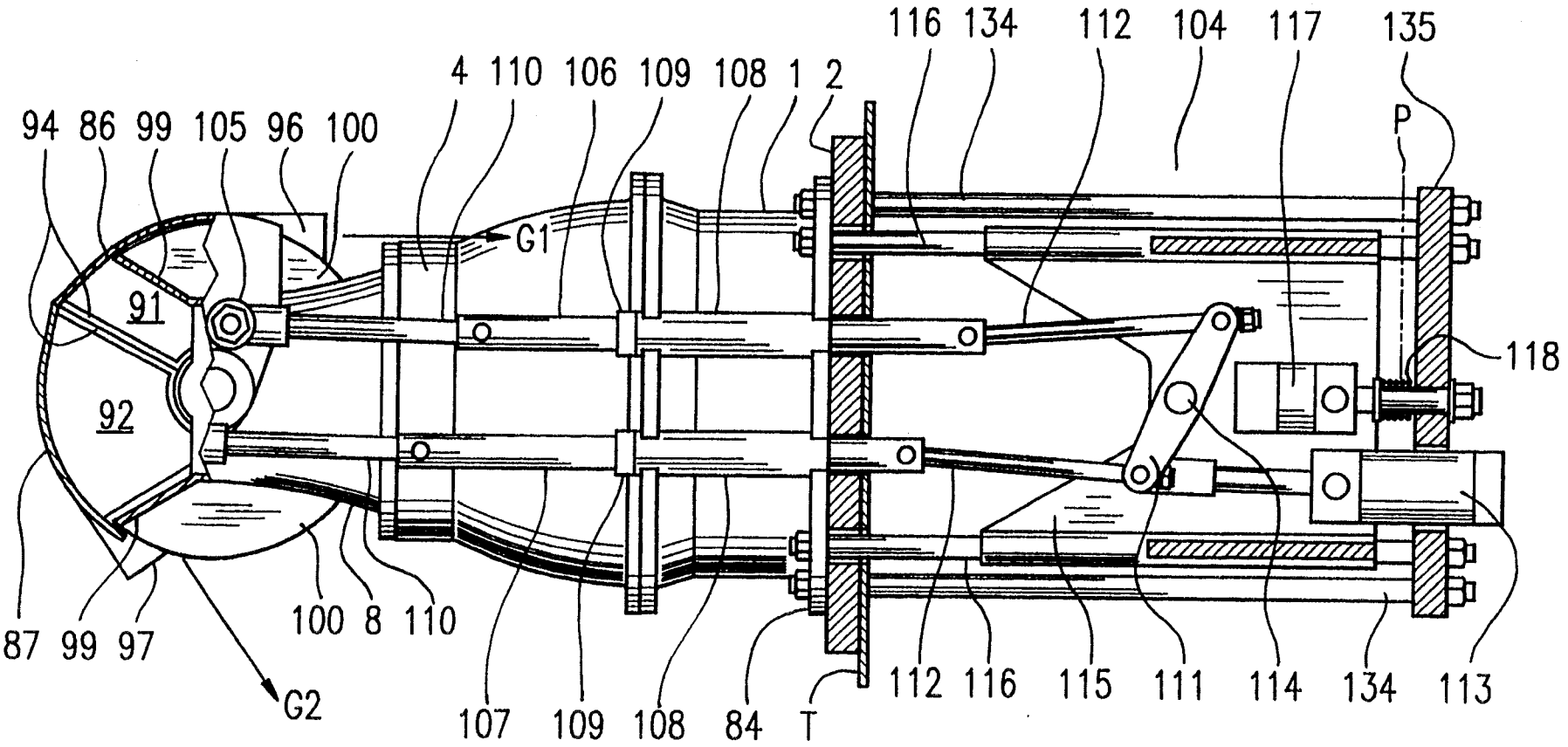
FIG. 5 is a fragmentary, partially broken plan view of the invention showing details of the steering and reversing system.

The steering/reversing deflectors 86 and 87 are each pivotally suspended about vertical axes, that may be parallel and separate or coincident. The present embodiment shows coincident suspension about a common upper pivot pin 89 and common lower pivot pin 90. These deflectors are located to each side of the nozzle and consist of segments, that may be cylindrical spherical or conical in shape or any combination of these. The present embodiment provides for the upper half to be conical and the lower half to be cylindrical. The nozzle shape generally matches this shape. Upon actuation of the left deflector 86 to engage the jet stream J, the reaction will be to turn the vessel to the right, the reaction being stronger as the deflector engages a larger portion of said jet stream. The opposite reaction will result from actuation of the right deflector 87. At the bottom of each deflector and below the jet stream J are disposed reversing ducts 96 and 97, rigidly attached to deflectors 86 and 87, so that they turn with said deflectors. When both deflectors are simultaneously fully engaged in the jet stream J and close off the rearward flow of the water, said jet stream's only escape will be down and forward through the reversing ducts 96 and 97, producing a forward flow G and a reverse reaction on the vessel. The orientation of said reverse ducts is such that the flow direction in straight reverse steering position, from reverse ducts 96 and 97, is approximately 30 degrees away from straight forward to the left and to the right, to avoid depositing aerated water near the jet drive intake duct 10. The direction is also approximately 30 degrees downward, so that the reverse flow may pass below the vessel transom T and below reverse/trim plane 101, when in the retracted position. These angles may vary, to suit specific requirements. The water flow to the reverse ducts 96 and 97 is divided by the inside vertical baffles 94 of the reverse ducts. In the reverse position, said vertical baffles come together and form a single flow divider. Reverse steering is obtained by rotating the steering/reverse deflectors in unison, as shown in FIGS. 4 and 5, where said deflectors and said flow divider are in the reverse, hard to port position. Left duct 96 has a small cross hatched area 91 feeding it, while cross hatched area 92 identifies the much larger area of flow to the right duct 97. This results in a reverse jet stream G2 much stronger than G1, resulting in a reverse left turn. One or more turning vanes 98 may be placed in reversing ducts 96 and 97, to promote efficient reverse flow and increase structural integrity of said reversing ducts. Alternately, in a different embodiment, the reverse duct may be replaced by a single split duct, rigidly attached to nozzle housing 8, placed below the steering/reverse deflectors. Said split duct having left and right outlet ports aimed in forward direction at angles approximately 30 degrees away from straight forward and approximately 30 degrees downward. The vertical baffles 94 remain rigidly attached to the steering/reversing deflectors and as before, when placed together in reverse, form a flow divider. Said vertical baffles extend to close proximity of the split reverse duct, preventing water from escaping into the opposite port. Steering action in reverse, causes flow variation to the right and left outlet and reverse steering action as a result. The advantage of this embodiment is a lower force on the vertical pivots 89 and 90, a lower strain on control rods 106 and 107 and less aeration of the intake duct 10 when steering in reverse, but no steering vanes 102 and 103 can be used.

A neutral position may be found by closing both deflectors 86 and 87 until the composite of reverse jet streams G1 and G2 is in balance with forward jet stream J.

In this embodiment, the conical shape of the upper parts of deflectors 86 and 87, serves to promote the jet flow downward to the reverse duct, without adversely affecting the steering function in forward. In other embodiments, a sideways reverse flow may be produced, or a combination of directions may be produced, depending on the shape of the nozzle discharge port and steering/reverse deflectors chosen.

Baffle 88 is located above nozzle discharge port 85, in the horizontal plane and prevents upward escape of the jet stream J, when the steering/reversing deflectors engage said jet stream. Baffles 99 are placed to each side of the nozzle discharge port 85 with their outer edges in close proximity to the steering deflectors, as shown in FIGS. 1, 2 and 3. Baffles 100 are located at the base of the nozzle in the horizontal plane and serve to form the upper walls of the reversing ducts 96 and 97. Baffle 88 and baffles 99 are joined respectively at their outward and upward edges; baffles 99 and 100 are joined at respectively the lowermost and rearmost edges, forming one continuous baffle arrangement, preventing jet stream escape in any direction but rearward or downward.

A steering and reversing control assembly 104 as shown in FIGS. 4 and 5 is coupled to the deflectors 86 and 87 with rod end bearings 105 for turning said deflectors into the jet stream J and may be hydraulically or mechanically or electromechanically actuated. The control assembly 104 is advantageously placed inside the vessel to protect said assembly from the corrosive action of water and air outside the transom T. Said assembly is suspended directly from the forward flange 84 of impeller housing 1. This permits the installation and alignment of the assembly 104 in the factory, without the presence of any components forward of transom flange 2. When the jet drive is installed on the vessel, the assembly 104 will be re-installed in identical fashion, without the need of adjustment or alignment of the linkages. A left control rod 106 and right control rod 107 are supported by linear bearings 108 and are provided with water seals 109 on the rearward ends to prevent water entry into the bearings and the vessel. Said control rods are pivotally connected to the left and right steering/reverse deflectors 86 and 87 via linkages 110 and rod end bearings 105. The forward ends of said control rods are pivotally linked to a bell crank 111, via linkages 112. Actuation, of said bell crank by steering cylinder 113, will cause the deflectors 86 and 87 to turn in unison, thereby providing steering action with the vessel in general forward movement. The bell crank pivot pin 114 is attached to a sliding base 115, slidably supported on two rods 116, that are rigidly attached to forward flange 84 of impeller housing 1, by means of stiffener rods 134 and back plate 135, permitting said base to slide along an axis in parallel to the control rods 106 and 107. The sliding base 115 is actuated by reverse control cylinder 117 and when it is moved in rearward direction, the deflectors 86 and 87 close to the reverse position and coil spring 118 maintains a controlled closing force. Steering action in reverse is obtained by actuation of the bell crank 111, by steering cylinder 113. A neutral position may be found by moving the sliding base 115 to a position between forward and reverse, until the thrust generated by forward and reverse flow balances. In addition, the reverse cylinder 117 may move sliding base 115 all the way forward to the park position, pulling both control rods 106 and 107 all the way forward, so that no surface of said rods, that forms a sealing surface for the water seals 109 is exposed to marine growth, during extended periods of non-use of the vessel.

In another embodiment, the sliding base 115 may be replaced with a base disposed in the same approximate position, but supported pivotally about a vertical axis, approximately the same distance forward of the transom as the bell crank pivot bolt 114 and more than the bell crank radius to either side of the jet drive centerline. The pivot support is rigidly mounted to the forward mounting flange 84 of impeller housing 1. The travel of bell crank pivot pin 114 in this embodiment will describe an arc with little deviation from the straight line, produced by slide 115. The linkages 112, pivotally attached to control rods 106 and 107 will compensate for said deviation.

The jet drive may further include left and right steering vanes 102 and 103, each attached to the outboard surfaces of reverse ducts 96 and 97 respectively, as seen in FIGS. 1, 2, 3, and 5. The rudders are disposed in the vertical plane, parallel with the vessel keel line K when the deflectors 86 and 87 are positioned for straight forward movement of the vessel. The steering action will as a result also cause the rudders to articulate in the desired direction. Steering vanes 102 and 103 may be attached rigidly or pivotally, with a shear bolt or with shear bolts only, to prevent damage to the reverse ducts 96 and 97 in case the rudders strike a solid object, so that they can break away or rotate out of the way.

Also included in the jet drive design is a reverse/trim plane 101, pivotally attached to the transom T, by hinge 130, below the jet drive, to prevent forward flowing water from reverse ducts 96 and 97 from hitting transom T and to favorably influence the performance of the vessel while moving forward. Hydraulic cylinders 131 position said reverse/trim plane during forward operation. A hydraulic valve 132 with roller actuator 136, mounted on the steering/reverse control back plate 135 is operated by cam 133, attached to sliding base 115 and causes the cylinders 131 to retract fully, when shifted in reverse. In forward mode the reverse/trim plane resumes its adjusted trim position, as hydraulic valve 132 is actuated by the forward movement of sliding base 115, via actuator 136 and cam 133.

The reverse/trim plane cylinders have a park position similar to the steering/reverse control rods, whereby the actuating cylinders 131 are in the fully retracted position, to prevent marine growth on the rod surfaces during protracted times of inactivity. When the slide base 115 moves all the way forward in the park position P, valve 132 is again actuated, causing the retraction of cylinders 131.

As described above, a neutral thrust position of the deflectors can be found, by moving sliding base 115 in between the forward and reverse positions.

I claim:

1. In an improved marine jet drive for propelling a vessel, having a forward end and a rearward end, having a rotatable impeller coupled to a vessel engine, an impeller housing around said impeller, a diffusor housing and nozzle housing attached to and rearward of said impeller housing, an intake duct, disposed forward of said impeller housing, a jet stream emanating rearward from said nozzle housing, the improvement comprising:

two steering deflectors pivotally supported on vertically disposed pivot means, attached to said nozzle housing;

baffle arrangement comprising at least one baffle rigidly attached to said nozzle housing to prevent escape of said jet stream forward and upward from said at least one baffle;

a steering baffle rigidly attached to one of said steering deflectors, said steering baffle forming a flow divider when said steering deflectors are in a closed position; and said jet stream being prevented from flowing rearward by said steering deflectors in said closed position and being prevented from flowing upward and forward by said at least one baffle, is forced to flow by said flow divider, regulating outflow to at least one reversing duct, the direction of said outflow being controlled by positioning the flow divider by rotation in unison of said steering deflectors in said closed position.

2. A marine jet drive according to claim 1 further comprising a reversing duct rigidly attached to at least one of said steering deflectors, said reversing duct receiving at least part of said jet stream, when said at least part of said jet stream is prevented from flowing rearward by said steering deflectors.

3. A marine jet drive according to claim 1 further comprising at least one fixed reversing duct rigidly attached to said nozzle housing, said fixed reversing duct receiving said jet stream, when at least part of said jet stream is prevented from flowing rearward.

4. A marine jet drive according to claim 1 further comprising:

a control mechanism comprising control rods attached to said deflectors, producing the movement of said deflectors to obtain deflection of said jet stream;

said mechanism also comprising a bell crank comprising two outer ends, each said outer end pivotally attached to one of said control rods, the actuation of said bell crank about its fulcrum point by a steering means producing movement of the deflectors in unison; and a reversing means, moving said fulcrum point substantially rearward, thereby moving said control rods in unison, closing said deflectors; and forward movement of said fulcrum point opening said deflectors.

5. A marine jet drive according to claim 4 further comprising a support base as a part of said control mechanism, said support base being attached rigidly but in removable manner to at least one of said impeller housing, diffusor housing and nozzle housing.

6. A marine jet drive according to claim 4 further comprising a control rod support means as part of said control mechanism and having a park position of said control mechanism, whereby said control rods are moved in a forward direction inside said rod support means as far as possible.

7. A marine jet drive according to claim 1 further comprising at least one steering vane, said at least one steering vane being rigidly and rotatably attached to at least one of said steering deflectors.

8. A marine jet drive according to claim 7 further comprising: said at least one steering vane secured to said at least one of two deflectors with at least one fastening device sized to shear under a predetermined load.

9. In an improved marine jet drive for propelling a vessel, having a forward end and a rearward end, having a rotatable impeller coupled to a vessel engine, an impeller housing around said impeller, a diffusor housing and nozzle housing attached to and rearward of said impeller housing, an intake duct, disposed forward of said impeller housing, a jet stream emanating rearward from said nozzle housing, the improvement comprising:

two deflectors pivotally supported on vertically disposed pivot means, attached to said nozzle housing;

at least one baffle rigidly attached to said nozzle housing to prevent escape of said jet stream forward and upward from said at least one baffle;

a control mechanism comprising control rods attached to said deflectors, producing the movement of said deflectors to obtain deflection of said jet stream;

said mechanism also comprising a bell crank comprising two outer ends, each said outer end pivotally attached to one of said control rods, the actuation of said bell crank about its fulcrum point by a steering means producing movement of said deflectors in unison; and a reversing means, moving said fulcrum point substantially rearward, thereby moving said control rods in unison, closing said deflectors and forward movement of said fulcrum point opening said deflectors.

10. A marine jet drive according to claim 9 further comprising a control rod support means as part of said control mechanism and having a park position of said control mechanism, whereby said control rods are moved in a forward direction inside said rod support means as far as possible.

11. A marine jet drive according to claim 9 further comprising at least one steering vane, said at least one steering vane being rigidly and rotatably attached to at least one of said steering deflectors.

* * * * *